US005150739A

United States Patent [19]

Blackwell et al.

[11] Patent Number: 5,150,739

[45] Date of Patent: Sep. 29, 1992

[54] WEFT FEEDING THROUGH AN ACCUMULATOR WITHOUT SUBSTANTIAL TWIST

[75] Inventors: Daniel C. Blackwell, Bear; Joseph E. Koskol, Wilmington, both of Del.

[73] Assignee: E. I. Du Pont de Nemours and Company, Wilmington, Del.

[21] Appl. No.: 728,457

[22] Filed: Jul. 11, 1991

[51] Int. Cl.[5] ..... D03D 47/34

[52] U.S. Cl. ..... 139/452

[58] Field of Search ..... 139/443, 452, 450; 226/97, 118

[56] References Cited

U.S. PATENT DOCUMENTS

| | | | |
|---|---|---|---|
| 3,499,589 | 1/1968 | Johnson et al. . | |
| 3,575,217 | 4/1971 | Pfarrwaller | 139/452 |
| 3,669,328 | 6/1972 | Castelli | 139/452 X |
| 3,712,526 | 9/1971 | Hamousek et al. . | |
| 3,993,233 | 1/1976 | Bartel . | |
| 4,127,275 | 2/1977 | King . | |
| 4,128,198 | 7/1977 | Woodley . | |
| 4,181,426 | 8/1978 | Blossey et al. . | |
| 4,469,265 | 12/1982 | Manquen . | |
| 4,479,518 | 10/1984 | Kiwior | 139/452 X |
| 4,589,580 | 1/1985 | Young, Jr. et al. . | |
| 4,591,084 | 6/1984 | Balian et al. . | |
| 4,947,897 | 8/1990 | Binnersley et al. | 139/452 X |

*Primary Examiner*—Andrew M. Falik

[57] ABSTRACT

A process and apparatus for the on-demand, low tension feeding of a filling member for weft insertion in a loom without substantial twist. The filling member is supplied without substantial twist at an average rate equal to the process speed take-up rate of the loom. The supplied filling member is advanced into a filling member accumulator from which the filling member is withdrawn by the loom. As the filling member is advanced into the accumulator, it is formed into serpentine folds. The supplying of the filling member is controlled in response to the filling member being taken up by the loom and a sufficient amount of the filling member is caused to accumulate in the accumulator to meet the high demand for the filling member when the loom accelerates to process speed operation.

19 Claims, 2 Drawing Sheets

WEFT FEEDING THROUGH AN ACCUMULATOR WITHOUT SUBSTANTIAL TWIST

BACKGROUND OF THE INVENTION

The present invention relates to a process and apparatus for the feeding of a filling member with low tension to a loom without substantial twist and more particularly relates to such a process and apparatus in which an amount of filling member is accumulated to meet high demand for the filling member when the loom rapidly accelerates.

Looms are available for weaving fabrics with a wide variety of weft yarns including those of high denier. It has been found that such looms are also useful when the weft is heavy denier monofilament of a thermoplastic polymer or a heavy denier composite tape. While the loom otherwise has the capability to handle such filling members, there are problems with feeding such filling members to the loom. For example, a rapier loom can nearly instantaneously accelerate to full process speed by virtue of its electro-magnetic clutch and brake system, e.g., ¼ second, and similarly go from full process speed to a stopped condition in the same time frame. During the rapid starting and stopping of the loom and also during normal running at the process speeds, it is necessary to keep the resisting tension low as the filling member is fed to the loom.

Known apparatus for supplying weft yarns to a loom typically feeds the yarn over end from a yarn package to meet the requirement of low resisting tension. However, this is unsuitable for heavy denier monofilament, composite tapes and certain stiff filling members since twist is inserted. If a substantial amount of twist is inserted in such heavy denier and/or stiff filling members, kinks can be introduced into the filling which may adversely affect the product and can cause process interruptions. With filling members such as monofilament which has a cross-sectional shape which is oblong, i.e., its width being longer than its thickness, this is a particular problem since typically no twist can be tolerated. In addition, it would be difficult to pull monofilament or other stiff filling members over end from a package since they will have a tendency to unravel from a package when the tension is released.

SUMMARY OF THE INVENTION

The invention provides a process and apparatus for the on-demand, low tension feeding of a filling member to weft insertion means of a loom without substantial twist. The invention is for use with a loom of the type in which the demand for the filling member by the loom increases rapidly as the loom accelerates from a stopped condition to process speed operation and decreases rapidly as the loom decelerates from process speed to the stopped condition. During process speed operation, the filling member is taken up by the weft insertion means at a process speed take-up rate.

In accordance with the invention, the filling member is supplied without substantial twist at an average rate equal to the process speed take-up rate by the weft insertion means of the loom. The supplied filling member is advanced, advantageously using fluid advancing means, into a filling member accumulator having an inlet for receiving the filling member and an outlet from which the filling member is withdrawn by the weft insertion means. As the filling member is advanced into the accumulator, it is formed into serpentine folds. The supplying of the filling member is controlled in response to the filling member being taken up by the weft insertion means and a sufficient amount of the filling member is caused to accumulate in the accumulator to meet the rapidly increasing demand for the filling member when the loom accelerates from the stopped condition to process speed operation.

In accordance with a preferred form of the invention, the controlling of the supplying of the filling member is performed by detecting when the filling member is being withdrawn from the accumulator, activating the supply means when the filling member is detected being withdrawn from the accumulator, and deactivating the supply means after a predetermined time when the sensor means does not detect the filling member being withdrawn from the accumulator.

In accordance with a more preferred form of the invention, the supplying of the filling member is selectively performed at a first rate to supply the filling member at a rate in excess of the process speed take-up rate of the weft insertion means and at a second rate to supply the filling member at a rate less than the process speed take-up rate of the loom. In addition, to control the supplying of the filling member, a predetermined amount of filling member in the accumulator is detected. The supplying of the filling member is performed at the first rate when the predetermined amount of filling member is not detected in the accumulator and is performed at the second rate when the predetermined amount of filling member is detected in the accumulator.

In accordance with a preferred embodiment of the invention, the filling member is detected by means of throughbeam photocells. Preferably, the filling member is supplied from a package without twist using driven roll means.

In accordance with a preferred form of the invention for feeding filling members with an oblong cross-section, the filling member is prevented from twisting as it is withdrawn from the outlet of the accumulator.

In accordance with a preferred apparatus of the invention, the filling member accumulator has two generally spaced-apart walls with the distance between the walls being such that the filling member forms the serpentine folds which advance toward the outlet. Preferably, the distance between the spaced-apart walls of the accumulator is between about 110% and about 175% of the width of the filling member.

The invention is suitable for a variety of filling members which are capable of being inserted as filling by a loom and is particularly advantageous for oblong cross-section filling members such as monofilaments and composite tapes comprised of continuous multifilament yarns imbedded in a matrix polymer. The filling member is supplied without excessive tension even though the loom starts and stops extremely quickly and the invention also provides compensation for the varying take-up demand within each pick cycle of the loom. Apparatus in accordance with the invention can be constructed so that the apparatus has no physical connection to the loom other than through the filling member. In addition, the apparatus can be easily designed to have only modest power requirements.

BRIEF DESCRIPTION OF THE DRAWINGS

The invention and its advantages are best understood from the following detailed description of a preferred embodiment when read in conjunction with the accompanying drawings in which.

DETAILED DESCRIPTION

Figure 1:
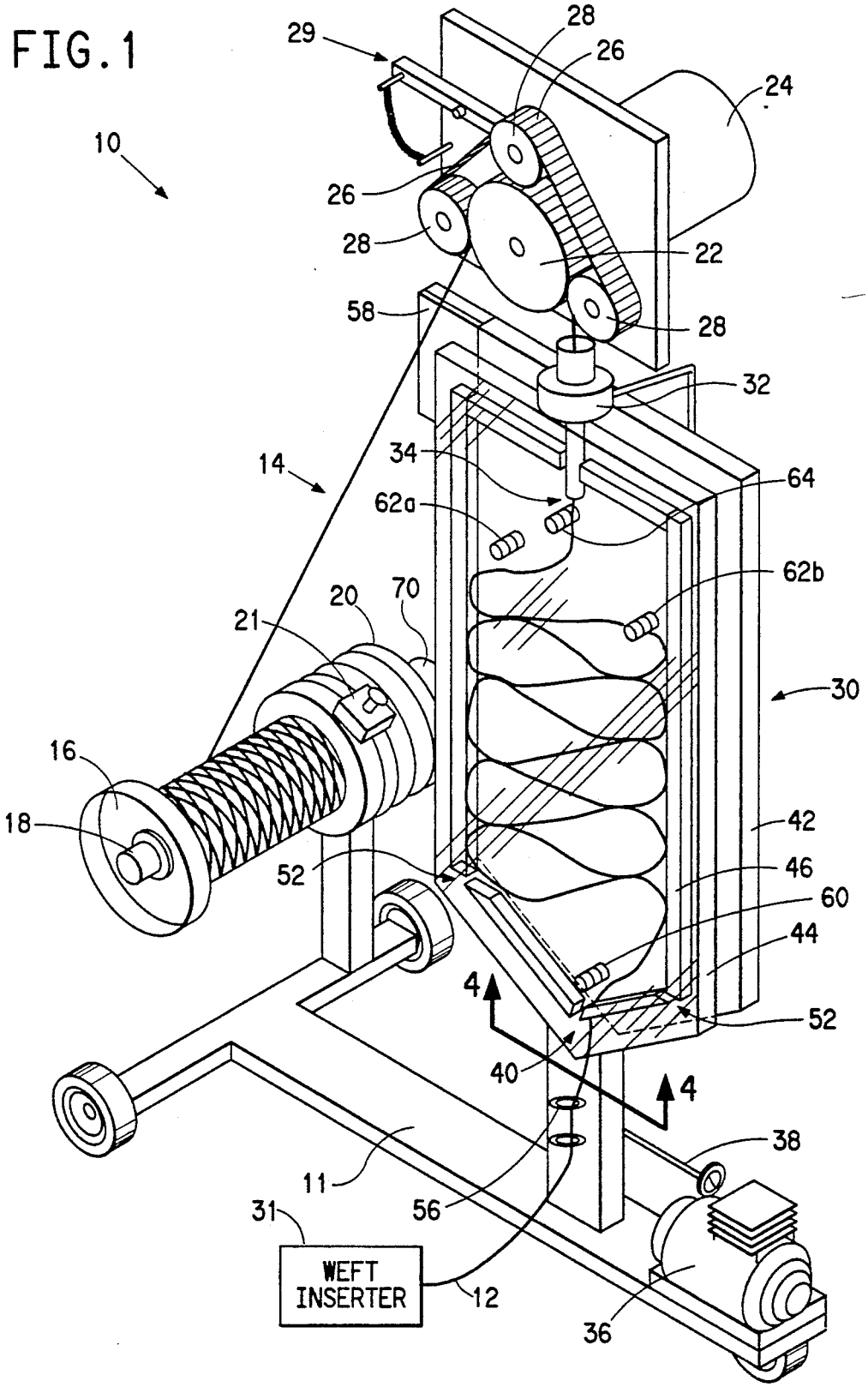
FIG. 1 is an isometric view of a preferred apparatus embodying the invention.

Referring to the drawings in which like reference characters designate like or corresponding parts throughout the several views, a preferred on-demand, low tension feed apparatus 10 is illustrated in FIG. 1. As will be explained in more detail hereinafter, the apparatus is useful for feeding a filling member 12 to a loom (not shown) of the type in which the demand for the filling member by the loom increases rapidly as the loom accelerates from a stopped condition to process speed operation and decreasing rapidly as the loom decelerates from process speed to the stopped condition. The words "process speed operation" as used in this application are not intended to imply that the loom must be operated at any particular operating speed but instead are intended to refer to the loom's normal speed for the chosen conditions of use.

The filling member 12 can be any of a variety of filling members which should not be substantially twisted as they are fed to the loom. For example, the invention is advantageously employed for heavy denier filling members such as heavy denier monofilaments of, for example, organic polymers such as polyamides, polyolefins, aramids and polyesters. The denier of such filling members can range anywhere from about 500 denier to as high as 25,000 denier or higher. Because of the stiffness of these monofilaments imparting substantial amounts of twist when fed to the loom may cause kinks which can produce a fabric defect or may require that the process be stopped even when the kinks are acceptable in the fabric. Thus, "without substantial twist" is intended to refer to no twist or the very low levels of twist which will not cause defects in the product or process difficulties.

Figure 4:
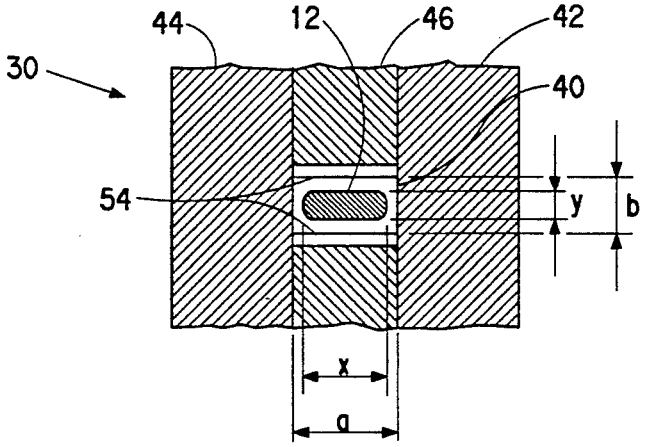
FIG. 4 is an enlarged, partial cross-sectional view of a monofilament in the accumulator which forms of part of the apparatus of FIG. 1 taken along line 4—4 of FIG. 1.

With reference now to FIG. 4 which shows a nylon monofilament with an oblong cross-section in cross-section in the apparatus as will be described in more detail hereinafter, the words "oblong cross-section" are intended to refer to a cross-section with its width (major dimension—"x" in FIG. 4) greater than its thickness (minor dimension—"y" in FIG. 4). Typically, for such filling members to provide advantages over similar round cross-sections, the width must be at least 1.5 times the thickness, i.e., a width-to-thickness ratio of 1.5. Often, filling members have a width-to-thickness ratio which is very high, e.g., as high as 20 or even higher. Different oblong cross-sections are possible including obround, i.e., generally rectangular with rounded corners or semi-circular ends, rectangular, oval, etc. The invention is also advantageously employed for composite tapes comprised of continuous multifilament yarns embedded in a matrix polymer. Examples of such tapes are those made from carbon fibers or aramid fibers such as that sold under the trademark Kevlar ® by E. I. du Pont de Nemours and Company embedded in a matrix of poly(etherether ketone). Typical tapes of this type which can be woven using a loom have a width of, for example, 0.25 inch and a thickness of 0.005–0.10 inches.

In general, no twist can be tolerated with oblong cross-section filling members since it is usually desirable to insert such members with the major dimension aligned with the plane of the fabric and any twist will produce a defect.

The looms for which the invention is particularly useful are high speed rapier looms having rapier weft insertion mechanisms which can provide on the order of 6 weft insertions per second or more. Such looms typically are driven using an electromagnetic clutch and brake system which enables the loom to start from a stopped condition and come up to process speed extremely quickly, for example, in approximately one-fourth of a second. Such looms typically can decelerate from full process speed to a stopped condition in approximately the same time. In most looms and in looms of this type, the weft insertion operation requires the feeding of the weft material with a highly variable speed during each weft insertion or "pick cycle". Thus, the weft material is rapidly taken up by the loom as the rapiers move across to insert the weft. However, the take-up rate at the end of weft insertion on either side of the resulting fabric is instantaneously zero.

Referring again to FIG. 1, the apparatus 10 for supplying the filling member 12 includes a frame 11 which supports filling member supply means designated generally by the numeral 14. The filling member supply means 14 includes a package 16 supported on a spindle 18 with an electro-magnetic brake 20 which is controllable as will be explained in more detail hereinafter. A frictional drag brake 21 is also provided to prevent filling member overfeed due to inertial rotation of the spindle 18 and package 16.

The filling member supply means 14 includes a drive roll 22 driven by a motor 24 which is used to pull the filling member 12 from the package 16. For low-strength filling members, spindle 18 and package 16 can be powered by motor 70, responsive to a tension sensing device (not shown) to minimize tension imparted to filling member 12 between package 18 and drive roll 22. The supply means 14 also includes a drive belt 26 which contacts the upper portion of the drive roll 22 and is carried by three idler rolls 28 spaced apart in a triangular fashion about the drive roll 22. The uppermost idler roll 28 is supported on a belt tensioner 29 which acts to urge the belt 26 upwardly which has the effect of keeping the belt 26 in contact with the upper portion of drive roll 22. The filling member 12 is carried between and in contact with both the drive roll 22 and the drive belt 26 for positive engagement of the filling member 12 with the drive roll 22. The drive roll and belt arrangement also serve to prevent the oblong filling member from twisting.

The filling member supply means 14 is capable of supplying the filling member at an average speed equal to the normal process speed take-up rate by the weft insertion means 31 of the loom. As will be explained in more detail hereinafter, the filling member supply means 14 preferably is operable at a first rate to supply the filling member at a rate in excess of the process speed take-up rate of the loom ("overspeed") and at a second rate to supply the filling member at a rate less than the process speed take-up rate of the loom ("underspeed").

Figure 2:
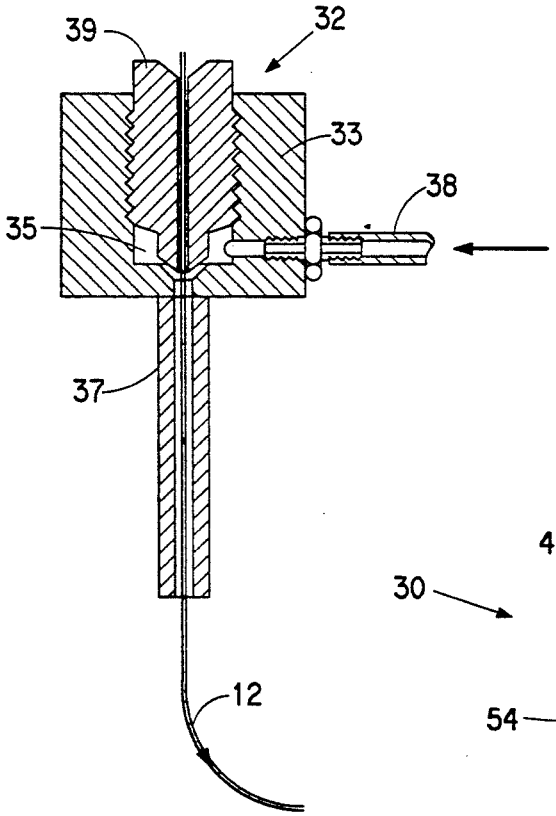
FIG. 2 is a cross-sectional view of a fluid jet forming a part of the apparatus depicted in FIG. 1.

Referring still to FIG. 1, the filling member 12 is preferably advanced into an accumulator 30 through action of fluid advancing means 32. With reference also to FIG. 2, the fluid advancing means 32 receives and acts to pull the filling member 12 from the drive roll 22 and advance it into an inlet 34 of the accumulator 30. Preferably, as illustrated in FIG. 1, the fluid advancing means 32 is a fluid jet supplied with compressed air by air compressor 36 mounted on the frame 11 and air hose 38. In the embodiment depicted as shown in more detail in FIG. 2, the air jet is of axially symmetric design and has a body 33 with a bore 35 connecting to a tube 37 which extends into the top of the accumulator to provide the inlet 34. A jet member 39 is threadably inserted into the bore 35 to provide an annular air supply space and has a tapering end which conforms to a tapering area of the bore 35 to form the axially symmetric jet. Although the type of jet illustrated works well and no twisting has been observed to occur as the filling member is advanced into the accumulator 30, it is believed that a dual impingement, rectangular type jet may be superior for oblong-cross-section monofilaments or tapes since it will match the cross-sectional shape of the filling member to further optimize jet performance.

Figure 3:
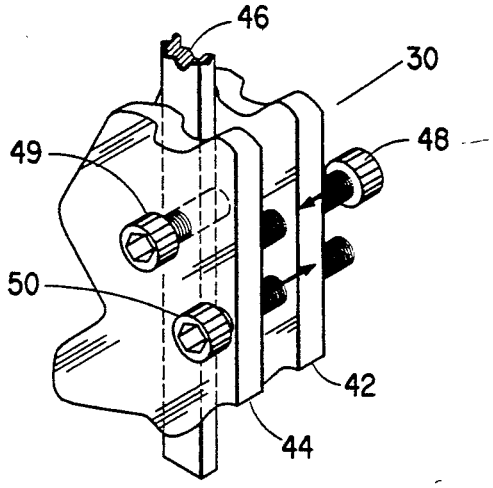
FIG. 3 is an enlarged, broken-away partial isometric view showing the construction of the accumulator which forms a part of the apparatus of FIG. 1.

Referring now to FIGS. 1, 3, and 4 the accumulator 30 depicted is supported by the frame 11 and has two generally evenly spaced-apart walls with the distance between the walls being such that, as the filling member is advanced into the accumulator, it forms serpentine folds. "Serpentine folds" are intended to refer to regular or irregular alternating back and forth loops without crossing or tangling. Thus, the spacing must be such that the folds of the filling member cannot cross within the accumulator but there must be sufficient space that the filling member and the folds of filling member can readily advance through the accumulator. The space between the walls is advantageously between about 110% and about 175% of the width of the filling member. Preferably, for oblong cross-section filling members which have been cross-wound on a package which produces some residual kinks at the reversals, the space between the walls is between about 125% and about 175% of the width of the filling member with the spacing on the order of about 150% being particularly preferred. This is illustrated in FIG. 4 in which the dimension "x" is the width of the filling member and the dimension "a" is the distance between the two walls. For round cross-section filling members which have been spirally wound which does not produce kinks, the spacing is preferably between about 110% and about 150% of the diameter of the filling member.

The accumulator 30 can be suitably constructed using a flat aluminum backplate 42 having a thickness of 1 inch and a flexible ½ inch sheet of acrylic plastic for its front wall 44. Alternately, a flat ground glass or ground aluminum plate, with a glass sight window if desired, can be used in place of the acrylic sheet. The surfaces of the backplate 42 and front wall 44 toward the interior of the accumulator should be smooth, e.g., a 32 RMS finish is adequate. The spacing between the plates is maintained by precision shim stock 46 which is selected to provide the spacing "a" in relation to the width "x" of the filling member 12 as described above. Along the perimeter of the accumulator 30 just outboard of the shim stock 46, a number of jacking screws 48 are provided as well as a number of clamping screws 50. (Jacking screws 48 and clamping screws 50 have been omitted in FIG. 1 and one of each is illustrated in FIG. 3.) The jacking screws 48 and clamping screws 50 are used to urge the acrylic plastic sheet 44 towards the backplate 42, clamping the shim stock 46 therebetween. The combination of jacking and clamping screws are used to make the flexible front plate conform to the rigid flat backplate 42 for uniform spacing "a" in the accumulator. Additional screws 49 (only shown in FIG. 3) pass through the acrylic sheet and shim stock and are threaded into the aluminum backplate are used to keep the shim stock in place and hold the assembly together.

The accumulator 30 is preferably sized to accumulate between about 5 and about 20 loom widths (picks) of the filling member 12. An advantageous size for the accumulator 30, when processing 2000–6000 denier polyamide monofilament with an oblong cross-section, is approximately 9 inches wide and 36 inches long with the last five inches tapered to "funnel" the product toward the outlet 40. For a 2000 denier nylon monofilament having a width "x" of 0.031 inches, a suitable spacing "a" is 0.047 inches for the accumulator 30 described above. Another illustration for a 6000 denier nylon monofilament with a width "x" of 0.055 inches, is a suitable spacing "a" of 0.094 inches. Near the bottom of the accumulator, exhaust slots 52 are provided by leaving part of the shim stock 46 vacant. It is convenient to do this at the location where the accumulator begins to taper. The exhaust slots 52 provide means for the air supplied by the fluid advancing means 32 to escape from the interior of the accumulator 30. Because the exhaust slots 52 are positioned near the exit end of the accumulator 30, a flow of air from the fluid advancing means at the inlet 34 is provided toward the outlet 40. This flow of air acts to advance the serpentine loops of filling member 12 toward the outlet 40. As in the preferred embodiment depicted, it is desirable for the exhaust slots 52 to be spaced apart from the outlet 40 so that the flow of air does not force the loops hard against the outlet 40 which can cause a jamming condition.

Referring now to FIG. 4, which shows a cross-sectional view toward the bottom of the accumulator in apparatus particularly adapted for use in feeding oblong-cross-section monofilament, the accumulator 30 in this embodiment includes means for preventing the filling member from twisting when the filling member 12 is withdrawn from the outlet 40 of the accumulator 30. Preferably, this is accomplished by providing an outlet 40 which is an aperature closely matched to the filling member 12. In the embodiment depicted, the ends of the shim stock 46 adjacent the outlet 40 are radiused and smooth to provide surfaces 54 which will not abrade the filling member 12. The aperature provided by the surfaces 54 is adjusted to a dimension "b" which exceeds the thickness "y" of the filling member to allow the filling member 12 to be withdrawn quickly from the accumulator but not to allow twisting. For example, a suitable dimension "b" for the aperature is about 0.005 inches in excess of the thickness "y" of the filling member. For round cross-sections, the shape of this aperature is not critical but sufficient clearance for free movement of the filling member should be provided.

If desired, one or both of the shim stock sections adjacent the outlet 40 can be articulated to swing downwardly to an open position to facilitate initial stringup.

Referring again to FIG. 1, the preferred apparatus includes a "feather guide" tensioner 56 just outside the outlet 40 of the accumulator 30. The tensioner 56 eliminates overfeed due to the momentum of the filling member 12 when the take-up demand for the filling member 12 decreases quickly, e.g., when the demand drops instantaneously to zero at the end of a pick cycle. Referring still to FIG. 1, the apparatus 10 is controlled by controller 58 and filling member sensors as will be described in detail hereinafter. The controller 58 and sensors act to control the filling member supply means 14 so that a sufficient amount of filling member 12 accumulates in the accumulator 30 to meet the rapidly increasing demand for the filling member 12 when the loom accelerates from its stopped condition to process speed operation.

In the preferred form of the invention depicted, a first sensor detects when the filling member is being withdrawn from the accumulator 30. While other types of sensors would also work including pneumatic, electrostatic, proximity, etc., the first sensor is advantageously provided by a throughbeam photocell 60 proximate to the outlet 40 which senses motion as the loops "wag" from side to side upon withdrawal from the accumulator 30. When the first sensor photocell 60 detects motion, the controller 58 is responsive to the sensor and acts to actuate the filling member supply means 14. The controller 58 is set so that if no motion is detected by the first sensor photocell 60 for a predetermined time period, the controller deactivates the filling member supply means 14 by deactivating the motor. The controller also causes the electromechanical brake 20 to stop the filling member from unwinding on the spindle 18 thereby preventing excess filling member from being left between the supply package 16 and the drive roll 22.

In the preferred form of the invention depicted, control over the supplying of the filling member is facilitated by supply means 14 being operable at the first "overspeed" rate to supply the filling member at a rate in excess of the process speed take-up rate of the loom and at the second "underspeed" rate to supply the filling member at a rate less than the process speed take-up rate of the loom. The apparatus 10 also includes a second sensor for detecting when a predetermined amount of filling member is in the accumulator 30 and the controller 58 is responsive to the second sensor. The controller 58 preferably operates the filling member supply means 14 at its overspeed rate when the second sensor does not detect the predetermined amount of filling member in the accumulator 30 and operates the filling member supply means 14 at slower underspeed rate when the predetermined amount of filling member is detected. Preferably, the second sensor 62 is provided by a pair of throughbeam photocells **62*a* and 62*b* which are located on either side of the inlet such as approximately 6 inches below the inlet 40. The controller 58 is set to default to overspeed and is set for a time period, e.g., about 1/10 of a second. If either photocell 62*a* or 62*b* sees a "flash by" of the filling member in this time period indicating an accumulator full of the predetermined amount of filling member, then the controller 58 selects the underspeed rate. Two sensors 62*a* and 62*b*** are preferably used since a pile up of loops can cause the incoming material to be diverted to one side or the other and thus not always be detected if only one sensor is used. Suitable overspeed and underspeed rates are ±2% of the process speed take-up rate of the loom.

In the preferred embodiment depicted, a third sensor is also provided to shut down the apparatus 10 when more than the predetermined amount of filling member is in the accumulator caused by a failure. This sensor is advantageously provided by a throughbeam photocell 64 positioned above photocells **62*a* and 62*b* and to one side of the inlet 40. If this sensor detects the filling member, the controller 58 deactivates the motor 24 of the supply means 14 and actuates the electromechanical brake 20**. The main purpose of this sensor is to prevent the feeding of the filling member onto the floor in the event that the other sensors fail to detect a stopped condition of the loom or a full accumulator or if the low supply rate of the filling member supply means is set too high.

The photocells 60, **62*a*, 62*b*, and 64** are suitably provided by ultraslim throughbeam photocells, model FU-75, sold by the Keyence Corporation of America, Cherry Hill, N.J. An amplifier sold by the same company, model FS-60 is suitable for use with the photocells.

In operation, the apparatus 10 when set for start-up will have the accumulator 30 full of serpentine loops of the filling member 12 to the amount normally detected by the photocells **62*a* and 62*b*. When the loom begins to operate, filling member 12 is rapidly withdrawn from the outlet 40 and the "wag" of the filling member past the first sensor 60 causes the controller 58 to actuate the filling member supply means 14. The filling member supply means 14 by default initially accelerates to its overspeed rate. Since the loom on start-up withdraws the filling member 12 at a rate faster than filling member supply means 14 can initially respond, the amount of filling member 12 initially in the accumulator is at least partially depleted. Until the amount of filling member 12 in the accumulator 30 is replenished, the filling member supply means 14 will operate in overspeed. When replenished, one or the other of the second sensor photocells 62*a* and 62*b* will detect the filling member 12 and the controller 58 will then cause the filling member supply means 14 to go into the underspeed mode. The slower rate will continue unless the filling member 12 is not detected for the predetermined time period when the controller 58 will cause the supply means to go back into the overspeed mode. As the operation of the loom continues, the controller 58 will cause the filling member supply means 14 to alternate between overspeed and underspeed to keep the accumulator 30 full of the predetermined amount of filling member. When the loom stops and product is not detected by the first photocell 60 for the predetermined amount of time, e.g., ½ second, the filling member supply means 14 is stopped by the deactivation of the motor 24 and the activation of the electromechanical brake 20. Before restart of the loom, controller 58 refills accumulator 30** to its start condition.

During operation, the amount of the filling member in the accumulator 30 is able to compensate for the varying demand for the filling member 12 during each pick cycle. Generally, the variation in demand due to the pick cycles is not sufficient for the sensors and controller 58 to detect when the apparatus 10 is set as described above and the operation of the apparatus is not usually affected by these variations. The tensioner 56 prevents filling member momentum from oversupplying of the filling member during the drops in demand in the pick cycle.

The apparatus 10 in accordance with the invention is capable of supplying a wide variety of filling members to the weft insertion means of a loom. The invention is advantageous for heavy denier monofilaments and other heavy denier filling members and is particularly advantageous for oblong cross-section monofilaments such as monofilaments of thermoplastic polymer, e.g., nylon or polyester and composite tapes comprised of continuous multifilament yarns embedded in a matrix polymer. The apparatus of the invention is capable of supplying the filling member even though the loom starts and stops extremely quickly and also provides compensation for the varying take-up demand within each picking cycle of the loom. The apparatus can be constructed so that it has no physical connection to the loom other than through the filling member 12 to be supplied and can be designed to have only modest power requirements.

While a preferred embodiment has been shown and described in the foregoing detailed description, it will be understood that the invention is capable of numerous modifications, rearrangements and substitution of parts without departing from the spirit of the invention as set forth in the appended claims.

We claim:

1. Apparatus for the on-demand, low tension feeding of a filling member to weft insertion means of a loom without substantial twist, the demand for said filling member increasing rapidly as said loom accelerates from a stopped condition to process speed operation and decreasing rapidly as said loom decelerates from said process speed operation to said stopped condition, said filling member being taken up by said weft insertion means at a process speed take-up rate during said process speed operation, said apparatus comprising:

filling member supply means for supplying said filling member without substantial twist at an average rate equal to said process speed take-up rat by said weft insertion means;

a filling member accumulator having an inlet for receiving said filling member from said supply means and an outlet from which said filling member is withdrawn by said weft insertion means;

said filling member accumulator having two generally evenly spaced-apart walls with the distance between said walls being such that said filling member forms serpentine folds within said filling member accumulator which advance into said accumulator as said filling member is received through said inlet; and control means for controlling said filling member supply means in response to said filling member being taken up by said weft insertion means and causing a sufficient amount of filling member to accumulate in said accumulator to meet the rapidly increasing demand for said filling member when said loom accelerates from said stopped condition to said process speed operation, said control means comprising:

first sensor means for detecting when said filling member is being withdrawn from said accumulator, said first sensor means being a throughbeam photocell positioned proximate said outlet;

means responsive to said first sensor for activating said supply means when said filling member is detected being withdrawn from said accumulator and deactivating said supply means after a predetermined time period when said first sensor means does not detect said filling member being withdrawn.

2. The apparatus of claim 1 wherein said filling member supply means is operable at a first rate to supply said filling member at a rate in excess of said process speed take-up rate of said loom and at a second rate to supply said filling member at a rate less than said process speed take-up rate of said loom, said control means further comprising a second sensor for detecting when a predetermined amount of filling member is in said accumulator and said means responsive to said second sensor operating said filling member supply means at said first rate when said second sensor does not detect said predetermined amount of filling member in said accumulator and operating said filling member supply means at said second rate when said predetermined amount of filling member is detected in said accumulator by said second sensor.

3. The apparatus of claim 2 further comprising a third sensor means for detecting when an amount of filling member in excess of said predetermined amount is present in said accumulator and means responsive to said third sensor to deactivate said supply means.

4. The apparatus of claim 3 wherein each of said first, second and third sensors comprise at least one through-beam photocells.

5. The apparatus of claim 2 wherein said second sensor comprises at least two spaced-apart through-beam photocells at positions in said accumulator such that each of said photocells is capable of detecting said predetermined amount of filling member in said accumulator.

6. Apparatus for the on-demand, low tension feeding of a filling member to weft insertion means of a loom without substantial twist, the demand for said filling member increasing rapidly as said loom accelerates from a stopped condition to process speed operation and decreasing rapidly as said loom decelerates from said process speed operation to said stopped condition, said filling member being taken up by said weft insertion means at a process speed take-up rate during said process speed operation, said apparatus comprising:

filling member supply means for supplying said filling member without substantial twist at an average rate equal to said process speed take-up rate by said weft insertion means;

a filling member accumulator having an inlet for receiving said filling member from said supply means and an outlet from which said filling member is withdrawn by said weft insertion means;

said filling member accumulator having two generally evenly spaced-apart walls with the distance between said walls being such that said filling member forms serpentine folds within said filling member accumulator which advance into said accumulator as said filling member is received through said inlet; and control means for controlling said filling member supply means in response to said filling member being taken up by said weft insertion means and causing a sufficient amount of filling member to accumulate in said accumulator to meet the rapidly increasing demand for said filling member when said loom accelerates from said stopped condition to said process speed operation, said apparatus further comprising fluid advancing means acting on said filling member for advancing said filling member from said supply means into said inlet of said accumulator.

7. The apparatus of claim 6 wherein filling member supply means comprises a package of said filling member and driven roll means to supply said filling member from said package to said fluid advancing means without substantial twist.

8. The apparatus of claim 7 wherein said filling member supply means further comprises a brake operable when actuated to rapidly stop the supplying of said filling member, said brake being responsive to said control means and being actuated when said control means deactuates said filling member supply means.

9. The apparatus of claim 6 wherein said fluid advancing means comprises an air jet.

10. The apparatus of claim 9 further comprising exhaust means in said accumulator positioned near said outlet for providing a flow of air toward said outlet.

11. Apparatus for the on-demand, low tension feeding of a filling member to weft insertion means of a loom without substantial twist, the demand for said filling member increasing rapidly as said loom accelerates from a stopped condition to process speed operation and decreasing rapidly as said loom decelerates from said process speed operation to said stopped condition, said filling member being taken up by said weft insertion means at a process speed take-up rate during said process speed operation, said apparatus comprising:

filling member supply means for supplying said filling member without substantial twist at an average rate equal to said process speed take-up rate by said weft insertion means;

a filling member accumulator having an inlet for receiving said filling member from said supply means and an outlet from which said filling member is withdrawn by said weft insertion means;

said filling member accumulator having two generally evenly spaced-apart walls with the distance between said walls being such that said filling member forms serpentine folds within said filling member accumulator which advance into said accumulator as said filling member is received through said inlet, the distance between the spaced-apart walls of said accumulator being between about 110% and about 175% of the width of the filling member; and control means for controlling said filling member supply means in response to said filling member being taken up by said weft insertion means and causing a sufficient amount of filling member to accumulate in said accumulator to meet the rapidly increasing demand for said filling member when said loom accelerates from said stopped condition to said process speed operation.

12. Apparatus for the on-demand, low tension feeding of a filling member to weft insertion means of a loom without substantial twist, the demand for said filling member increasing rapidly as said loom accelerates from a stopped condition to process speed operation and decreasing rapidly as said loom decelerates from said process speed operation to said stopped condition, said filling member being taken up by said weft insertion means at a process speed take-up rate during said process speed operation, said apparatus comprising:

filling member supply means for supplying said filling member without substantial twist at an average rate equal to said process speed take-up rate by said weft insertion means;

a filling member accumulator having an inlet for receiving said filling member from said supply means and an outlet from which said filling member is withdrawn by said weft insertion means;

said filling member accumulator having two generally evenly spaced-apart walls with the distance between said walls being such that said filling member forms serpentine folds within said filling member accumulator which advance into said accumulator as said filling member is received through said inlet; and control means for controlling said filling member supply means in response to said filling member being taken up by said weft insertion means and causing a sufficient amount of filling member to accumulate in said accumulator to meet the rapidly increasing demand for said filling member when said loom accelerates from said stopped condition to said process speed operation, said filling member having an oblong cross-section and said apparatus further comprising means for preventing said filling member from twisting when said filling member is withdrawn from said outlet of said accumulator.

13. The apparatus of claim 12 wherein ~~said~~ means of preventing said filling member from twisting at said exit of accumulator is an aperature dimensioned to enable said filling member to freely be withdrawn from said accumulator while preventing said filling member from twisting.

14. A process for the on-demand, low tension feeding of a filling member to weft insertion means of a loom without substantial twist, the demand for said filling member increasing rapidly as said loom accelerates from a stopped condition to process speed operation and decreasing rapidly as said loom decelerates from said process speed operation to said stopped condition, said filling member being taken up by said weft insertion means at a process speed take-up rate during said process speed operation, said process comprising:

supplying said filling member without substantial twist at an average rate equal to said process speed take-up rate by said weft insertion means;

advancing said filling member being supplied into a filling member accumulator having an inlet for receiving said filling member and an outlet from which said filling member is withdrawn from said accumulator by said weft insertion means, said advancing of said filling member into said accumulator comprising providing fluid advancing means adjacent said inlet, supplying a fluid to said fluid advancing means, receiving said filling member into said fluid advancing means, pulling said filling member by action of said fluid advancing means being supplied with said fluid to advance said filling member into said inlet of said accumulator;

forming said filling member into serpentine folds as said filling member is advanced into said accumulator and advancing said folds toward said outlet; and controlling the supplying of said filling member in response to said filling member being taken up by said weft insertion means and causing a sufficient amount of said filling member to accumulate in said accumulator to meet the rapidly increasing demand for said filling member when said loom accelerates from said stopped condition to said process speed operation.

15. The process of claim 14 wherein said controlling of said filling member supply means is performed by detecting when said filling member is being withdrawn from said accumulator, activating said supply means when said filling member is detected being withdrawn from said accumulator, and deactivating said supply means after a predetermined time when said first sensor means does not detect said filling member being withdrawn from said accumulator.

16. The process of claim 15 wherein said supplying of said filling member is selectively performed at a first rate to supply said filling member at a rate in excess of said process speed take-up rate of said weft insertion means and at a second rate to supply said filling member at a rate less than said process speed take-up rate of said loom, said controlling of said supplying further comprising detecting when a predetermined amount of filling member is in said accumulator and operating said filling member supply means at said first rate when said predetermined amount of filling member is not detected in said accumulator and operating said filling member supply means at said second rate when said predetermined amount of filling member is detected in said accumulator.

17. The process of claim 14 wherein said filling member is supplied without substantial twist using a driven roll means to supply said filling member from a package.

18. The process of claim 14 further comprising preventing said filling member from twisting when said filling member is withdrawn from said exit of said accumulator.

19. The process of claim 14 wherein said advancing of said filling member into said accumulator comprises providing an air jet adjacent said inlet, supplying compressed air to said air jet, receiving said filling member into said air jet, pulling said filling member by action of said air jet being supplied with compressed air to advance said filling member into said inlet of said accumulator.

* * * * *